US009367001B1

(12) United States Patent
Kitajima et al.

(10) Patent No.: US 9,367,001 B1
(45) Date of Patent: Jun. 14, 2016

(54) IMAGE FORMING APPARATUS AND IMAGE FORMING METHOD

(71) Applicant: FUJI XEROX CO., LTD., Tokyo (JP)

(72) Inventors: Katsuyuki Kitajima, Kanagawa (JP); Naoki Ota, Kanagawa (JP); Nagahito Ichijo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/934,786

(22) Filed: Nov. 6, 2015

(30) Foreign Application Priority Data

May 29, 2015 (JP) ..... 2015-110339

(51) Int. Cl.
*G03G 9/08* (2006.01)
*G03G 15/20* (2006.01)
*G03G 9/087* (2006.01)

(52) U.S. Cl.
CPC ..... *G03G 15/20* (2013.01); *G03G 9/0804* (2013.01); *G03G 9/087* (2013.01)

(58) Field of Classification Search
CPC .. G03G 9/0804; G03G 9/087; G03G 9/08797
See application file for complete search history.

(56) References Cited

U.S. PATENT DOCUMENTS 7,056,638 B1 6/2006 Tomita et al.
2015/0063846 A1 3/2015 Fukai

FOREIGN PATENT DOCUMENTS

JP 2004-145243 A 5/2004
JP 2011-158758 A 8/2011
JP 2015-052644 A 3/2015

*Primary Examiner* — Erika J Villaluna
(74) *Attorney, Agent, or Firm* — Sughrue Mion, PLLC

(57) ABSTRACT

An image forming apparatus includes a fixing unit that fixes a toner image on a surface of a recording medium while transporting the recording medium with a contact portion of a first member and a second member, and a moving unit that moves at least one of the first member and the second member toward a direction intersecting with a transport direction of the recording medium, wherein a toner has a sea and island structure of a sea portion containing a binder resin and an island portion containing a release agent, a maximum frequent value in distribution of the eccentricity B of the island portion containing the release agent is in a range of from 0.75 to 0.95, a skewness in the distribution of the eccentricity B is from −1.10 to −0.50, and the eccentricity B is defined in the specification.

11 Claims, 5 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2015-110339 filed May 29, 2015.

BACKGROUND

1. Technical Field

The present invention relates to an image forming apparatus and an image forming method.

2. Related Art

Methods for visualizing image information, such as electrophotography, are currently used in various fields. In the electrophotography, an electrostatic latent image as image information is formed on the surface of an image holding member by charging and forming an electrostatic latent image. Further, a toner image is formed on the surface of the image holding member by a developer containing a toner, the toner image is transferred onto a recording medium, and then the toner image is fixed on the recording medium. Through such processes, the image information is visualized as an image.

SUMMARY

According to an aspect of the invention, there is provided an image forming apparatus including:

an image holding member;

a charging unit that charges a surface of the image holding member;

an electrostatic latent image forming unit that forms an electrostatic latent image on a charged surface of the image holding member;

a developing unit that stores a developer containing a toner and develops the electrostatic latent image formed on the surface of the image holding member by using the developer so as to form a toner image;

a transfer unit that transfers the toner image onto a surface of a recording medium;

a fixing unit that includes a first member and a second member contacting with the first member, and fixes the toner image transferred on the surface of the recording medium while transporting the recording medium with a contact portion of the first member and the second member; and a moving unit that moves at least one of the first member and the second member toward a direction intersecting with a transport direction of the recording medium, wherein the toner contains a binder resin, a colorant, and a release agent and has a sea and island structure of a sea portion containing the binder resin and an island portion containing the release agent, a maximum frequent value in distribution of the following eccentricity B of the island portion containing the release agent is in a range of from 0.75 to 0.95, and a skewness in the distribution of the following eccentricity B is in a range of from −1.10 to −0.50, the eccentricity B being represented by the following expression (1):

$$\text{Eccentricity } B=2d/D \quad (1)$$

wherein D indicates an equivalent circle diameter (μm) of the toner in an observation of a cross-section of the toner, and d indicates a distance (μm) from the centroid of the toner to the centroid of the island portion containing the release agent in the observation of a cross-section of the toner.

BRIEF DESCRIPTION OF THE DRAWINGS

Exemplary embodiments of the present invention will be described in detail based on the following figures, wherein.

DETAILED DESCRIPTION

Figure 1:
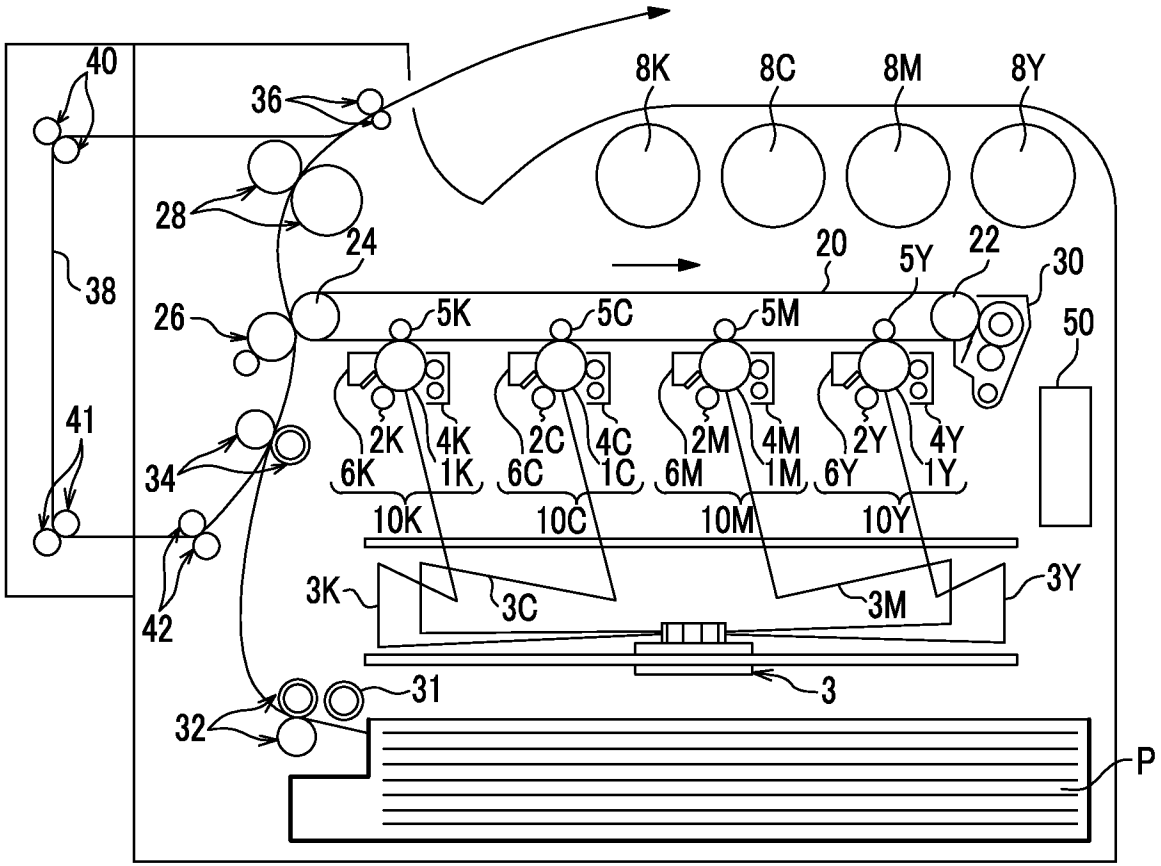
FIG. 1 is a schematic configuration diagram illustrating an example of an image forming apparatus according to this exemplary embodiment.

Hereinafter, an exemplary embodiment which is an example of the invention will be described in detail.

An image forming apparatus according to this exemplary embodiment includes an image holding member, a charging device, an electrostatic charge image forming device, a developing device, a transfer device, and a fixing device. The charging device charges a surface of the image holding member. The electrostatic charge image forming device forms an electrostatic charge image on the charged surface of the image holding member. The developing device stores an electrostatic charge image developer, and develops the electrostatic charge image formed on the surface of the image holding member by using the electrostatic charge image developer so as to obtain a toner image. The transfer device transfers the toner image formed on the surface of the image holding member onto a surface of a recording medium. The fixing device fixes the toner image which has been transferred onto the surface of the recording medium.

The fixing device is a fixing device which includes a first member and a second member contacting with the first member, and, while transporting a recording medium with a contact portion of the first member and the second member, fixes a toner image transferred on a surface of the recording medium. The image forming apparatus further includes a device which moves at least one of the first member and the second member toward a direction intersecting with a transport direction of the recording medium.

A toner contains toner particles. The toner particle contains a binder resin, a colorant, and a release agent, and has a sea and island structure of a sea portion containing the binder resin and an island portion containing the release agent. In the sea and island structure, the maximum frequent value in distribution of eccentricity B being represented by Expression (1) of the island portion containing the release agent is in a range of from 0.75 to 0.95. The skewness in the distribution of the eccentricity B is in a range of from −1.10 to −0.50.

$$\text{eccentricity } B=2d/D \quad \text{Expression (1):}$$

wherein D indicates an equivalent circle diameter (μm) of a toner in observation of a cross-section of the toner particle. d indicates a distance (μm) from the centroid of the toner particle to the centroid of the island portion containing the release agent in the observation of the cross-section of the toner particle.

With the above configuration, the image forming apparatus according to this exemplary embodiment prevents occurrence of offset (phenomena in which a portion of a fixed image adheres to a member of the fixing device) in an image forming apparatus which includes a fixing device which has a first member and a second member contacting with the first member, and a device which moves at least one of the first member and the second member toward a direction intersecting with a transport direction of a recording medium. The reason is assumed as follows.

First, in an electrophotographic image forming apparatus, when a toner image on a recording medium is repeatedly fixed, the recording medium repeatedly passes through the same position of the contact portion (also referred to as a "nip portion" below) of the first member and the second member in the fixing device. Thus, a wound (also referred to as a "paper transport wound" below) may occur on outer circumferential surfaces of the first member and the second member due to contacting with an end portion of the recording medium.

Thus, an image forming apparatus including a device (also referred to as a "moving device" below) in order to prevent occurrence of the paper transport wound has been known. The moving device moves at least one of the first member and the second member in the fixing device toward a direction intersecting with a transport direction of a recording medium. At least one of the first member and the second member in the fixing device is moved toward the direction intersecting with the transport direction of a recording medium by the moving device, and thus a position of a recording medium passing through a nip portion of the first member and the second member is shifted. That is, a contact position of outer circumferential surfaces of the first member and the second member, with an end portion of a recording medium is changed in fixing. For this reason, the occurrence of a paper transport wound on the outer circumferential surfaces of the first member and the second member is prevented.

In the image forming apparatus including the moving device, in order to cause the first member and the second member of the fixing device to perform fixing even when the first member and the second member are moved toward the direction intersecting with the transport direction of a recording medium, the first member and the second member are set as members having a width wider than that of a recording medium (that is, members having a length in an axial direction longer than that of the recording medium). For this reason, pressure (also referred to as "nip pressure" below) at the nip portion of the first member and the second member fluctuates in an axial direction of the member and thus becomes uneven easily. Bleeding of the release agent from the toner particle is insufficient and detachability of the member of the fixing device from a fixed image is low, at a place at which the nip pressure is low, so that offset may be caused.

In order to prevent occurrence of the offset, it is effective that the release agent is unevenly distributed to a surface layer portion side of the toner particle. This is because the release agent easily bleeds from the toner particle even at a place at which the nip pressure is low in the case where the release agent exists at the surface layer portion of the toner particle.

However, if the release agent exists only at the surface layer portion of the toner particle, when images are formed on both sides of the recording medium (that is, when double-sided printing is performed), offset may occur in the fixed image which has been fixed on the front surface (primary surface) of the recording medium, in fixing (second fixing) of a toner image onto a back surface of the recording medium which is performed after a toner image is fixed (firstly fixed) onto a front surface (primary surface) of the recording medium. If the release agent exists only at the surface layer portion of the toner particle, the release agent bleeds much from the toner particle in first fixing, and the amount of the release agent remaining in the fixed image on the front surface (primary surface) of the recording medium is excessively small. For this reason, it is considered that in second fixing, the amount of bleeding of the release agent from the fixed image on the front surface (primary surface) of the recording medium is small, and thus detachability of the member in the fixing device from the fixed image become to thereby cause the offset.

On the contrary, in the case of applying a toner particle which has a sea and island structure of a sea portion containing the binder resin and an island portion containing the release agent, and in which the maximum frequent value in the distribution of eccentricity B at an island portion containing the release agent, which is represented by Expression (1), and the skewness in the distribution of the eccentricity B are in the above ranges, the release agent easily bleeds from the toner particle even at a place at which the nip pressure at the nip portion of the first member and the second member in the fixing device is low, and a bleeding amount of the release agent from a fixed image on the front surface (primary surface) of a recording medium is easily ensured in second fixing even when double-sided printing is performed.

Here, the eccentricity B at the island portion containing the release agent (also referred to as a "release agent domain" below) is an index indicating a distance of the centroid of the release agent domain from the centroid of the toner particle. An increase of a value of the eccentricity B indicates that the release agent domain exists closer to the surface of the toner particle. A decrease of a value of the eccentricity B indicates that the release agent domain exists closer to the center of the toner particle. The maximum frequent value in the distribution of the eccentricity B indicates a portion at which the release agent domains exist in the largest amount in a radial direction of the toner particle. The skewness in the distribution of the eccentricity B indicates bilateral symmetry of the distribution. Specifically, the skewness in the distribution of the eccentricity B indicates the amount of unevenness from the maximum frequent value in the distribution. That is, the skewness in the distribution of the eccentricity B indicates the distribution state of the release agent domain from the portion at which the release agent domains exist in the largest amount in the radial direction of the toner particle.

Figure 5:
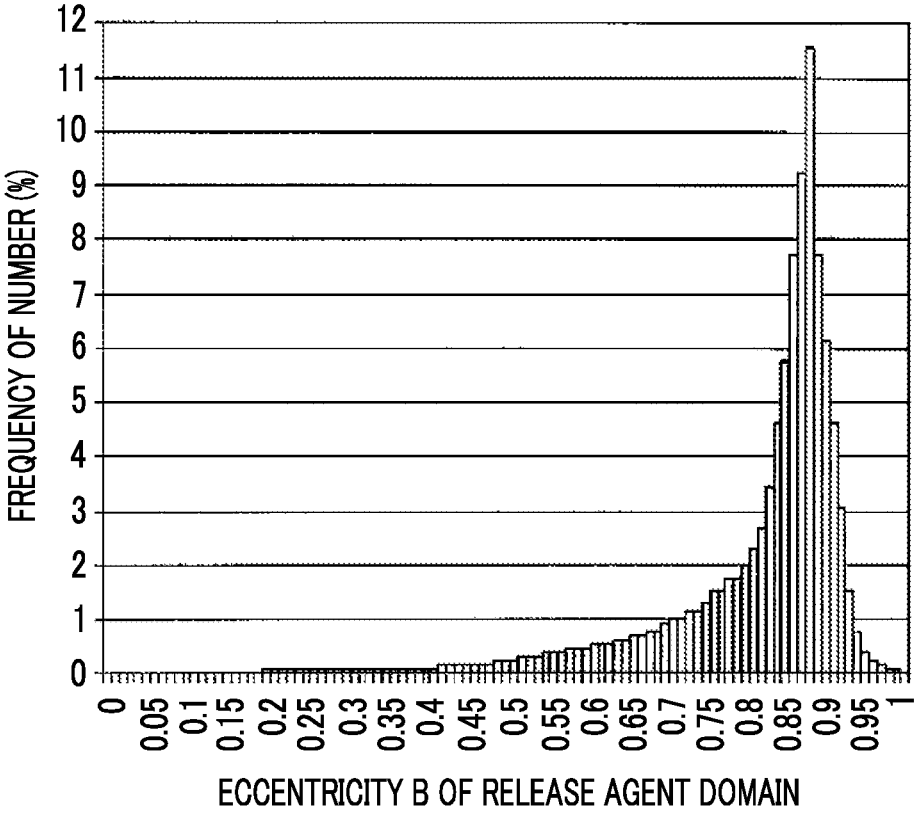
FIG. 5 is a diagram illustrating an example of a distribution of eccentricity B of a release agent domain in toner particles.

That is, the maximum frequent value in the distribution of the eccentricity B of the release agent domain being in a range of from 0.75 to 0.95 means that the release agent domains exist in the largest amount at the surface layer portion of the toner particle. The skewness in the distribution of the eccentricity B of the release agent domain being in a range of from −1.10 to −0.50 means that the release agent domain is distributed so as to have a gradient from the surface layer portion of the toner particle to the inside thereof (see FIG. 5).

In this manner, the toner particle in which the maximum frequent value and the skewness in the distribution of the eccentricity B of the release agent domain respectively satisfy the above-described ranges is a toner particle in which the most release agent domains exist the most at the surface layer portion and is distributed so as to have a gradient from the inside of the toner particle toward the surface layer portion.

That is, since the release agent domains exist in the largest amount at the surface layer portion in the toner particle having a gradient in the distribution of the release agent domain, the release agent easily bleeds from the toner particle even at a place at which the nip pressure at the nip portion of the first member and the second member is low in the fixing device. Since the release agent is distributed so as to have a gradient from the inside of the toner particle toward the surface layer portion in this toner particle having a gradient in the distribution of the release agent domain (that is, since a certain amount of the release agent exists in the inside of the toner particle), when double-sided printing is performed, even though the release agent bleeds from the surface layer portion of the toner particle in first fixing, the amount of the release agent remaining in the fixed image on the front surface (primary surface) of the recording medium is not excessively small. For this reason, in second fixing, a bleeding amount of the release agent from the fixed image on the front surface (primary surface) of the recording medium is easily ensured.

Accordingly, detachability of the member of the fixing device from the fixed image is high even at a place at which the nip pressure at the nip portion of the first member and the second member is low in the fixing device, and detachability of the member of the fixing device from the fixed image on the front surface (primary surface) of the recording medium is also high in second fixing even when the double-sided printing is performed.

From the above, the image forming apparatus according to this exemplary embodiment is presumed to prevent the occurrence of offset in the image forming apparatus including the moving device.

A method of increasing a fixation temperature is used for preventing occurrence of offset in the image forming apparatus including the moving device. However, a period of time is required for performing set-up and thus productivity is deteriorated in the above method. In addition, a method of decreasing a glass transition temperature of the binder resin in the toner, a method of increasing the content of the release agent, and the like are used. However, storability of the toner is deteriorated.

It is considered that the image forming apparatus according to this exemplary embodiment also prevents variation in the amount of bleeding of the release agent (wax), and thus occurrence of uneven gloss on an image is easily prevented.

Here, in the image forming apparatus according to this exemplary embodiment, an image forming method (image forming method according to this exemplary embodiment) including processes as follows is performed: a charging process of charging a surface of the image holding member; an electrostatic charge image forming process of forming an electrostatic charge image on the charged surface of the image holding member; a developing process of developing the electrostatic charge image formed on the surface of the image holding member by using an electrostatic charge image developer according to this exemplary embodiment so as to form a toner image; a transfer process of transferring the toner image formed on the surface of the image holding member onto a surface of a recording medium; fixing processing of fixing the toner image transferred onto the surface of the recording medium while transporting the recording medium with the contact portion of the first member and the second member contacting with the first member; and a process of moving at least one of the first member and the second member toward the direction intersecting with the transport direction of the recording medium.

As the image forming apparatus according to this exemplary embodiment, the well-known image forming apparatus is used. Examples of the well-known image forming apparatus include a direct transfer type apparatus that directly transfers a toner image formed on a surface of an image holding member to a recording medium; an intermediate transfer type apparatus that primarily transfers a toner image formed on a surface of an image holding member to a surface of an intermediate transfer member, and secondarily transfers the toner image which has been transferred onto the surface of the intermediate transfer member to a surface of a recording medium; an apparatus including a cleaning device that cleans a surface of an image holding member after transferring of a toner image and before charging; and an apparatus including an erasing device that performs erasing by irradiating a surface of an image holding member with eraser light after transferring of a toner image and before charging.

In a case of the intermediate transfer type apparatus, for example, a configuration is applied in which an intermediate transfer member to the surface of which the toner image is transferred, a primary transfer device that primarily transfers the toner image formed on the surface of the image holding member onto a surface of the intermediate transfer member, and a secondary transfer device that secondarily transfers the toner image transferred on the surface of the intermediate transfer member onto the surface of the recording medium are included.

An example of the image forming apparatus according to this exemplary embodiment will be described below with reference to the drawing. Main components illustrated in the drawing will be described and descriptions of other components will be omitted.

FIG. 1 is a schematic configuration diagram illustrating the image forming apparatus according to this exemplary embodiment.

The image forming apparatus illustrated in FIG. 1 includes first to fourth electrophotographic image forming units 10Y, 10M, 10C, and 10K that respectively print images of yellow (Y), magenta (M), cyan (C), and black (K) based on color-separated image data. These image forming units (which may be simply referred to as "units" below) 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer member 20 as an intermediate transfer member is installed above the units 10Y, 10M, 10C, and 10K in the drawing through the units. The intermediate transfer member 20 is wound on a driving roller 22 and a support roller 24 contacting with the inner surface of the intermediate transfer member 20, which are separated from each other on the left and right sides in the drawing, and the intermediate transfer member 20 travels in a direction toward the fourth unit 10K from the first unit 10Y. The support roller 24 is pressed in a direction in which it departs from the driving roller 22 by a spring or the like (not illustrated), and a tension is applied to the intermediate transfer member 20 wound on both of the rollers. In addition, an intermediate transfer member cleaning device 30 is provided on a surface of the intermediate transfer member 20 on the image holding member side so as to face the driving roller 22.

Toners of four colors are respectively stored in developing devices 4Y, 4M, 4C, and 4K of the units 10Y, 10M, 10C, and 10K. That is, a yellow toner, a magenta toner, a cyan toner, and a black toner contained in toner cartridges 8Y, 8M, 8C, and 8K are respectively supplied to the developing devices 4Y, 4M, 4C, and 4K.

The first to fourth units 10Y, 10M, 10C, and 10K have the same configuration. Thus, only the first unit 10Y that is disposed on the upstream side in a traveling direction of the intermediate transfer member and forms a yellow image will be representatively described here. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y includes a photoreceptor 1Y as the image holding member. Around the photoreceptor 1Y, a charging device 2Y, an electrostatic charge image forming device 3, a developing device 4Y, a primary transfer device 5Y, and a photoreceptor cleaning device 6Y are arranged in sequence. The charging device 2Y charges a surface of the photoreceptor 1Y to a predetermined potential. The electrostatic charge image forming device 3 exposes the charged surface with light 3Y based on a color-separated image signal to form an electrostatic charge image. The developing device 4Y supplies a charged toner to the electrostatic charge image to develop the electrostatic charge image. The primary transfer device 5Y transfers the developed toner image onto the intermediate transfer member 20. The photoreceptor cleaning device 6Y removes the toner remaining on the surface of the photoreceptor 1Y after primary transfer.

The primary transfer device 5Y is disposed inside the intermediate transfer member 20 to be provided at a position facing the photoreceptor 1Y. Bias supplies (not illustrated) that apply a primary transfer bias are respectively connected to the primary transfer devices 5Y, 5M, 5C, and 5K. Each of the bias supplies changes a transfer bias that is applied to each of the primary transfer devices.

An example of an operation of forming a yellow image in the first unit 10Y will be described below.

First, before the operation, the surface of the photoreceptor 1Y is charged by the charging device 2Y.

The electrostatic charge image forming device 3 outputs the light 3Y to the charged surface of the photoreceptor 1Y in accordance with image data for yellow. The surface of the photoreceptor 1Y is irradiated with the light 3Y, and thereby an electrostatic charge image of a yellow image pattern is formed on the surface of the photoreceptor 1Y.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at this developing position by the developing device 4Y. The surface of the photoreceptor 1Y is allowed to pass through the developing device 4Y, and thus the yellow toner electrostatically adheres to the electrostatic latent image on the surface of the photoreceptor 1Y, and thereby the latent image is developed by using the yellow toner. The photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer device 5Y and an electrostatic force toward the primary transfer device 5Y from the photoreceptor 1Y acts on the toner image, and thereby the toner image on the photoreceptor 1Y is transferred onto the intermediate transfer member 20. The toner remaining on the photoreceptor 1Y is removed and collected by the photoreceptor cleaning device 6Y.

In this manner, the intermediate transfer member 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer member 20 onto which the four color toner images which have been multiply-transferred onto through the first to fourth units reaches a secondary transfer portion that is made of the intermediate transfer member 20, the support roller 24 contacting with the inner surface of the intermediate transfer member 20, and a secondary transfer device 26 disposed on the image holding surface side of the intermediate transfer member 20. A recording sheet P is transported to a gap between the secondary transfer device 26 and the intermediate transfer member 20, which contact with each other, through a supply mechanism at a predetermined timing, and a secondary transfer bias is applied to the support roller 24. The transfer bias applied at this time has the same polarity as the polarity of the toner. An electrostatic force toward the recording sheet P from the intermediate transfer member 20 acts on the toner image, and thereby the toner image on the intermediate transfer member 20 is transferred onto the recording sheet P.

Here, the recording sheet P in a state of being stored in a recording sheet container is picked out by a pickup roller 31. The drawn recording sheet P is transported by a pair of feed rollers 32, and then is transported to the secondary transfer portion by a pair of alignment rollers (resist rollers) 34 at a predetermined timing.

Then, the recording sheet P is transported to the fixing device 28 such that the toner image is fixed on the recording sheet P, and thereby a fixed image is formed.

The recording sheet P on which fixing of the color image is completed is discharged toward a discharge unit by a pair of discharge rollers 36, and a series of the color image forming operations is ended.

When the double-sided printing is performed, the recording sheet P is reversely transported (switched-back) by the pair of discharge rollers 36, is transported to the pair of alignment rollers again through a double-sided printing feed path 38 configured by pairs of feed rollers 40, 41, and 42, and then is transported to the secondary transfer portion. After the toner image is transferred to the back surface side, the recording sheet P is transported to the fixing device 28, the toner image is fixed on the recording sheet P, and thereby a fixed image is formed. Then, the recording sheet P on which fixing of a color image is completed is discharged to a discharge portion by the pair of discharge rollers 36.

The image forming apparatus illustrated in FIG. 1 includes a control device 50 for controlling operations of each of the devices (or units of each device). Various operations of the image forming apparatus illustrated in FIG. 1 are controlled by the control device 50. That is, the various operations of the image forming apparatus illustrated in FIG. 1 are performed by a control program which is executed by the control device 50.

The representative configuration of the image forming apparatus illustrated in FIG. 1 will be described below in detail. Descriptions will be made with omitting of the marks of "Y, M, C, and K".

Photoreceptor

The photoreceptor 1 includes a conductive substrate, an undercoating layer formed on the conductive substrate, and a photosensitive layer formed on the undercoating layer, for example. The photosensitive layer may have a two-layer structure of a charge generation layer and a charge transport layer. The photosensitive layer may be an organic photosensitive layer, or an inorganic photosensitive layer. The photoreceptor 1 may have a configuration in which a protective layer is provided on the photosensitive layer.

Charging Device

The charging device 2 is provided on the surface of the photoreceptor 1 in a contact or a non-contact manner, for example. Although not illustrated, the charging device 2 includes a charging member for charging the surface of the photoreceptor 1 and a power source for applying a charging voltage to the charging member. The power source is electrically connected to the charging member.

As the charging member of the charging device 2, a contact charging member is exemplified. Examples of the contact charging member include a charging roller, a charging brush, a charging film, a charging rubber blade, and a charging tube which are conductive. As the charging member, a well-known charger may be used, and examples thereof include a non-contact roller charging member, and a scorotron charging member or corotron charging member using corona discharge.

Electrostatic Charge Image Forming Device

As the electrostatic charge image forming device 3, optical system equipment is exemplified, and the optical system equipment exposes the surface of the photoreceptor 1 with light such as a semiconductive laser beam, LED light, and light for a liquid crystal shutter according to an image data. A wavelength of light emitted from the light source is in a range of spectral sensitivity of the photoreceptor 1. With respect to the wavelength of the semiconductive laser, near-infrared area rays having an oscillation wavelength in the vicinity of 780 nm are mainly used. However, it is not limited to this wavelength. A laser having a wavelength oscillation in a range of from 600 nm to less than 700 nm or, as blue laser, a laser having an oscillation wavelength from 400 nm to 450 nm may be also used. A surface-emitting laser light source of a type which may output multi-beam is also effective for forming a color image.

Developing Device

The developing device 4 is provided on a downstream side of an irradiation position with the light 3 by the electrostatic charge image forming device 3, in a rotation direction of the photoreceptor 1, for example. A storing portion (not illustrated) for storing the developer is provided in the developing device 4. The electrostatic charge image developer containing a toner is stored in this storing portion.

Although not illustrated, the developing device 4 includes a developing member and a power source for applying a developing voltage to the developing member, for example. The developing member develops an electrostatic latent image formed on the surface of the photoreceptor 1 by using the developer containing the toner. The developing member is electrically connected to the power source, for example.

The developing member of the developing device 4 is selected depending on the kind of the developer. For example, a developing roller including a developing sleeve which covers a magnet is exemplified.

In the developing device 4, for example, the developing voltage is applied to the developing member and the developing member to which the developing voltage is applied is charged to have a developing potential in accordance with the developing voltage. The developing member charged to have the developing potential holds the developer stored in the developing device 4 on the surface and supplies the toner contained in the developer to the surface of the photoreceptor 1 from the inside of the developing device 4, for example.

The toner supplied onto the photoreceptor 1 adheres to the electrostatic charge image on the photoreceptor 1, for example, by using an electrostatic force. In detail, for example, a potential difference in a region in which the photoreceptor 1 faces the developing member of the developing device 4, that is, the toner contained in the developer is supplied to a region of the photoreceptor, in which the electrostatic charge image is formed, by a potential difference between a potential of the surface of the photoreceptor 1 and a developing potential of the developing member of the developing device 4 in the region. When carriers are contained in the developer, the carriers are collected into the developing device 4 in a state of being held to the developing member.

Primary Transfer Device

The primary transfer device 5 is provided on a downstream side of an installation position of the developing device 4 in the rotation direction of the photoreceptor 1, for example. Although not illustrated, the primary transfer device 5 includes a transfer member and a power source for applying a transfer voltage to the transfer member, for example. The transfer member transfers the toner image formed on the surface of the photoreceptor 1 to the intermediate transfer member 20. The transfer member has a columnar shape, for example, and is provided so as to interpose the intermediate transfer member 20 between the transfer member and the photoreceptor 1. The transfer member is electrically connected to the power source, for example.

Examples of the transfer member of the primary transfer device 5 include a contact transfer charger using a belt, a roller, a film, a rubber blade, or the like, and a well-known non-contact transfer charger such as a scorotron transfer charger or a corotron transfer charger which uses corona discharge.

Intermediate Transfer Member

As the intermediate transfer member 20, a belt-shaped member (intermediate transfer belt) containing polyimide, polyamideimide, polycarbonate, polyarylate, polyester, rubber or the like to which semiconductivity is imparted is used. As a form of the intermediate transfer member 20, a drum-shaped member may be used in addition to a belt-shaped member.

Secondary Transfer Device

Although not illustrated, the secondary transfer device 26 includes a transfer member and a power source, for example. The transfer member transfers the toner image formed on the surface of the intermediate transfer member 20 to the recording sheet P. The power source applies a transfer voltage to the transfer member. The transfer member has a columnar shape, for example, and is provided so as to interpose the recording sheet P between the intermediate transfer member 20 and the transfer member. The transfer member is electrically connected to the power source, for example.

Examples of the transfer member of the secondary transfer device 26 include a contact transfer charger using a belt, a roller, a film, a rubber blade, or the like, and a well-known non-contact transfer charger such as a scorotron transfer charger or a corotron transfer charger which uses corona discharge.

Photoreceptor Cleaning Device

The photoreceptor cleaning device 6 is provided on a downstream side of the primary transfer device 5 in the rotation direction of the photoreceptor 1. The photoreceptor cleaning device 6 performs cleaning by removing a residual toner adhering to the photoreceptor 1 after the toner image is transferred to the recording sheet P. The photoreceptor cleaning device 6 performs cleaning by removing a sticking matter such as paper powder, in addition to the residual toner.

As the photoreceptor cleaning device 6, a blade type device is exemplified. The blade type device has a blade which contacts with the surface of the photoreceptor 1 and removes a residual toner. In addition, the photoreceptor cleaning device 6 also includes a known cleaning device such as a brush type device.

Fixing Device

Figure 2:
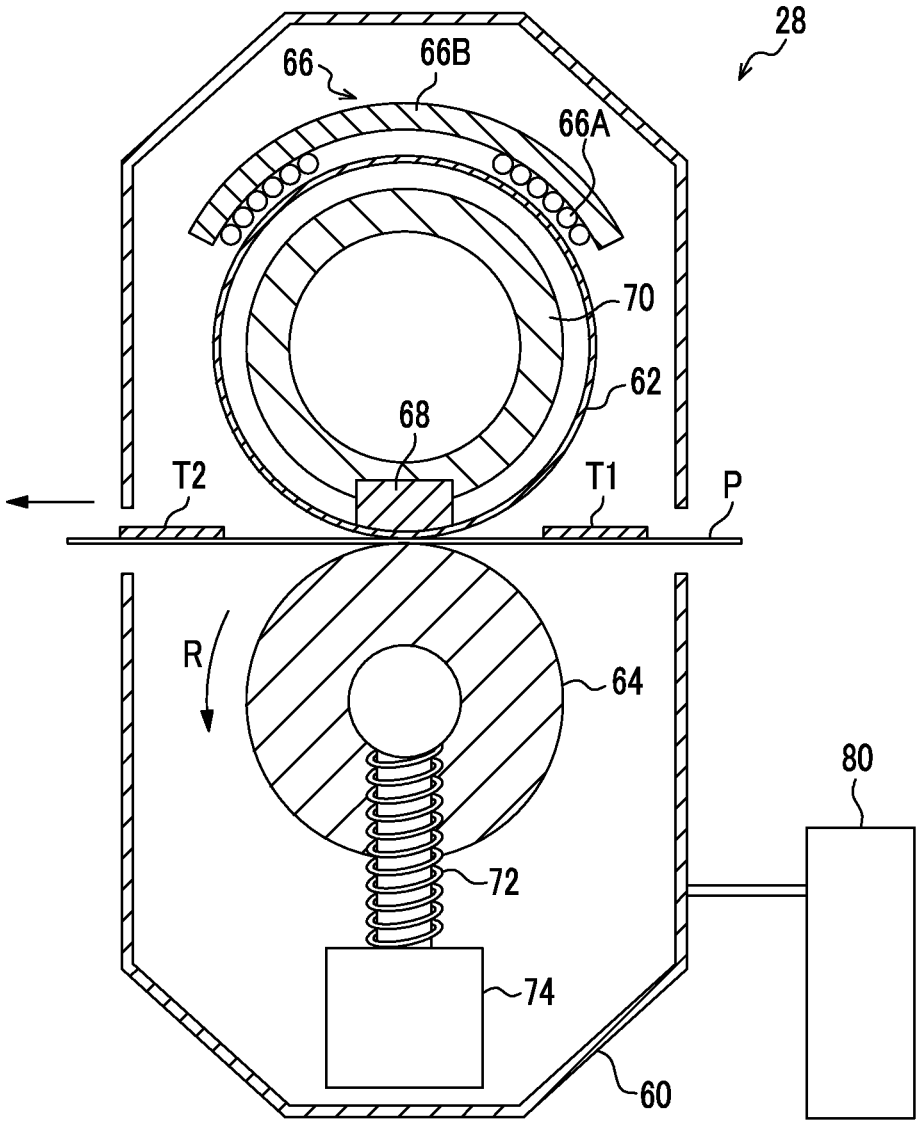
FIG. 2 is a schematic configuration diagram illustrating an example of a fixing device in the image forming apparatus according to this exemplary embodiment.

As illustrated in FIG. 2, the fixing device 28 is an electromagnetic induction heating fixing device, for example. In a housing 60, a fixation belt 62 (an example of a first member) having a metallic heating layer (not illustrated), a pressure roller 64 (an example of a second member), and an electromagnetic induction portion 66 are included. In the fixation belt, a pressure pad 68 and a pad support member 70 for supporting the pressure pad 68 are disposed. In FIG. 2, T1 indicates a toner image before fixing. T2 indicates a fixed image.

The pressure roller 64 is supported by the housing 60 such that the pressure roller 64 is rotatable in a direction which is indicated by an arrow R, by a driving source (not illustrated). The fixation belt 62 and the pressure roller 64 contact with each other so as to allow the recording sheet P to be inserted and passed. The fixation belt 62 may be driven-rotated in accordance with rotation of the pressure roller 64 in the direction indicated by the arrow R. The pressure pad 68 is disposed on an inner circumferential surface side of the fixation belt 62 so as to contact the inner circumferential surface. The pressure roller 64 is disposed on an outer circumferential surface side (outer circumferential surface of the fixation belt 62) of a place contacting with the pressure pad 68, so as to contact the outer circumferential surface. A contact portion which allows the recording sheet P to be inserted and passed is formed on the outer circumferential surface side of the fixation belt 62.

Here, the pressure roller 64 is supported by an elastic member 72 (for example, spring and the like) in a state where the pressure roller 64 is pressed on the pressure pad 68 via the fixation belt 62. The pressure roller 64 is linked to a driving member 74 (for example, an actuator of performing extension driving, and the like), which separates the pressure roller 64 from the fixation belt 62 against a pressing force of the elastic member 72.

An electromagnetic induction portion 66 for the pad support member 70 is provided on the outer circumferential surface side of the fixation belt 62 on an opposite side of the pressure pad 68, so as to be separated from the outer circumferential surface with a predetermined gap.

The electromagnetic induction portion 66 includes an electromagnetic induction coil 66A which is disposed so as to be separated from the outer circumferential surface of the fixation belt 62. The electromagnetic induction coil 66A is fixed by a coil support member 66B. The coil support member 66B is provided on an opposite side of the outer circumferential surface of the fixation belt 62 with respect to the electromagnetic induction coil 66A. The electromagnetic induction coil 66A is connected to a power source (not illustrated). When an AC current flows in the electromagnetic induction coil 66A, a magnetic field may be generated in the electromagnetic induction coil 66A so as to intersect with (for example, be orthogonal to) the outer circumferential surface of the fixation belt 62. A direction of the magnetic field is changed by an excitation circuit (not illustrated) such that the magnetic field may cause an eddy current to be generated in a metallic heating layer included in the fixation belt 62.

The housing 60 is supported through a guide member (for example, slide guide) such that the housing 60 is allowed to be moved in a direction intersecting with the transport direction of the recording sheet P (for example, an axial direction of the pressure roller 64). The housing 60 is linked to a device 80 (referred to as a "moving device" below) of moving the fixing device 28 (that is, the fixation belt 62 and the pressure roller 64) in the direction intersecting with the transport direction of the recording sheet P.

Moving Device

Although not illustrated, the moving device 80 includes a rotation motor as a driving source and an operation conversion mechanism, for example. The operation conversion mechanism converts rotation torque of the rotation motor into a linear operation in the direction intersecting with the transport direction of the recording sheet P. An operation of the operation conversion mechanism acts on the housing 60 of the fixing device 28, and the fixing device 28 (that is, the fixation belt 62 and the pressure roller 64) is shifted to the direction intersecting with the transport direction of the recording sheet P.

Examples of the operation conversion mechanism include a ball-screw mechanism, a pinion-rack mechanism, and the like. As the rotation motor, for example, a motor (servo motor, stepping motor, and the like) capable of being operated with a required operation amount is used.

As a motor of the moving device 80, a motor (linear motor and the like) which performs a linear operation may be employed. In this case, the operation conversion mechanism is not required.

The fixing device 28 is not limited to an electromagnetic induction heating fixing device, and usable is a known fixing device having a configuration in which a heating member having a heating source, such as a halogen lamp and a ceramic heater, and a pressure member are included. The fixing device 28 may be a fixing device of any one of a roller and roller type, a belt and belt type, and a belt and roller type.

The fixation temperature by the fixing device is preferably lower than 190° C., more preferably 100° C. or more and less than 190° C., and most preferably in a range of from 160° C. to 180° C. in this exemplary embodiment.

Operation of Fixing Device and Moving Device

Operations of the fixing device and the moving device will be described. These operations are controlled by the control device 50.

First, a fixing operation by the fixing device 28 will be described.

First, the pressure roller 64 is rotated in the direction indicated by the arrow R, and the fixation belt 62 is drivenly rotated in accordance with the rotation of the pressure roller 64. Then, a magnetic field is generated by the electromagnetic induction coil 66A and the rotating fixation belt 62 is exposed to the generated magnetic field. At this time, an eddy current is generated in the metallic heating layer in the fixation belt 62 by the electromagnetic induction coil 66A to thereby generate heat. Thus, heating is performed up to a temperature (approximately from 150° C. to 200° C.) allowing the outer circumferential surface of the fixation belt 62 to enable fixation.

A predetermined region of the outer circumferential surface of the fixation belt 62 is heated by using the above method and the heated region moves to the contact portion with the pressure roller 64 in accordance with the rotation of the fixation belt 62. Meanwhile, the recording sheet P on the surface of which the toner image is formed is transported. When the recording sheet P passes through the contact portion, the toner image contacts the heated region of the fixation belt 62 and thus is heated and fixed on the surface of the recording sheet P. The region of the fixation belt 62 in which the fixing at the contact portion is ended and the surface temperature of the outer circumferential surface is decreased is moved to a place to be heated by the electromagnetic induction coil 66A, in accordance with the rotation of the fixation belt 62. Heating is performed again on the moved region of the fixation belt 62 in preparation for the following fixing process.

Next, the operation of the moving device 80 will be described.

Figure 3A:
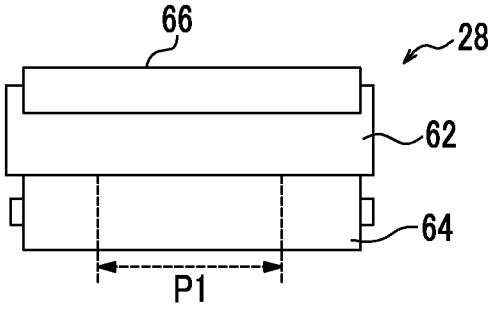
FIGS. 3A to 3D are schematic diagrams illustrating an operation of moving the fixing device (fixation belt and pressure roller) toward a direction intersecting with a transport direction of a recording sheet.
Figure 3B:
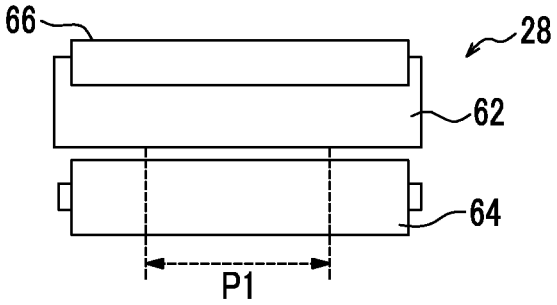

First, the driving member 74 is driven in a state where the pressure roller 64 is pressed on the fixation belt 62 (specifically a state where the pressure roller 64 is pressed on the pressure pad 68 through the fixation belt 62: see FIG. 3A). Thus, the driving member 74 causes the pressure roller 64 to recede in a direction separated from the fixation belt 62 against a pressing force of the elastic member 72 (see FIG. 3B). Accordingly, pressing by the pressure roller 64 is released.

Figure 3C:
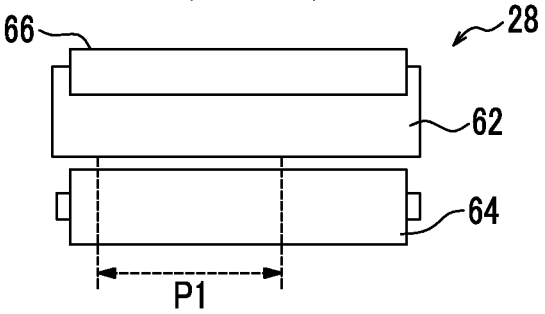

Then, the moving device 80 is driven so as to shift the fixing device (that is, the fixation belt 62 and the pressure roller 64) in the direction interesting with the transport direction of the recording sheet P (specifically, for example, direction along the axial direction of the pressure roller 64) (see FIG. 3C). A direction in which the fixing device 28 is shifted (one or another direction of directions intersecting with the transport direction of the recording sheet P) and the amount of shifting the fixing device 28 are set to be in ranges of a predetermined shift direction and a predetermined shift amount, based on the type of the recording sheet P, the amount of the recording sheet P passing through the nip portion, or a period of time (fixing time) when the recording sheet P passes through the nip portion.

Figure 3D:
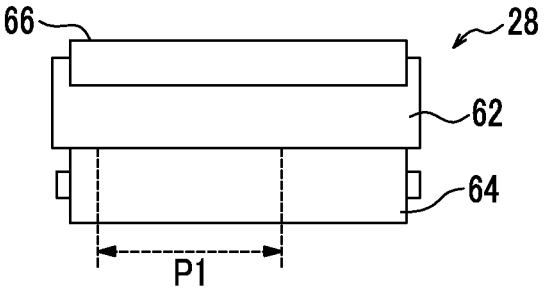

Then, the moving device 80 is driven so as to release recession of the pressure roller 64 from the fixation belt 62, and with the pressing force of the elastic member 72, a state where the pressure roller 64 is pressed on the fixation belt (specifically, a state where the pressure roller 64 is pressed on the pressure pad 68 through the fixation belt 62: see FIG. 3D) is restored.

In FIGS. 3A to 3D, P1 indicates a passing position of the recording sheet P at the nip portion of the fixation belt 62 and the pressure roller 64.

These series of operations of the moving device 80 cause the passing position of the recording sheet P through the nip portion of the fixation belt 62 and the pressure roller to be changed. Thus, occurrence of wound on the outer circumferential surfaces of the fixation belt 62 and the pressure roller, which is caused by contacting with the end portion of the recording sheet P, is prevented.

Here, as a time when an operation of the moving device 80 is performed (time when an operation of shifting the fixing device 28 is performed), any of the following (A) to (D) or a combination thereof is included, for example.

(A) The operation is periodically performed every time the passing time of the recording sheet P (a period of time during which fixing is performed) at the nip portion of the fixation belt 62 and the pressure roller 64 reaches a predetermined passing time.

(B) The operation is periodically performed every time a passing amount of the recording sheet P at the nip portion of the fixation belt 62 and the pressure roller 64 reaches a predetermined passing amount.

(C) The operation is performed during stopping of formation of an image (for example, in an initial setting operation such as an operation in which correction data for image density or gray scale is obtained).

An example in which the moving device 80 causes the entirety of the fixing device 28 to be shifted is described. However, it is not limited thereto. A portion including at least the fixation belt 62 and the pressure roller 64 may be shifted or one of the fixation belt 62 and the pressure roller 64 may be shifted.

Control Device

The control device 50 is configured as a computer which performs control for the entirety of the apparatus and various computations. Specifically, although not illustrated, the control device includes a central processing unit (CPU), a read only memory (ROM) that stores various programs, a random access memory (RAM) that is used as a work area when a program is executed, a non-volatile memory that stores various types of information, and an input and output interface (I/O). The CPU, the ROM, the RAM, the non-volatile memory, and the I/O are connected to each other through a bus.

Although not illustrated, the image forming apparatus illustrated in FIG. 1 includes an image forming unit, an operation display unit, an image processing unit, an image memory, a storage unit, a communication unit, and the like in addition to the control device 50, for example. Each of the operation display unit, the image processing unit, the image memory, the image forming unit, the storage unit, and the communication unit is connected to the I/O of the control device 50. The control device 50 controls each of the units by performing transmission and reception of information between the units of the image forming unit, the operation display unit, the image processing unit, the image memory, a storage unit, and the communication unit.

The descriptions are made by using the image forming unit as the main component of the image forming apparatus 10. That is, the image forming unit includes the photoreceptor 1, the charging device 2, the electrostatic charge image forming device 3, the developing device 4, the primary transfer device 5, the driving roller 22 of the intermediate transfer member 20, the secondary transfer device 26, the fixing device 28, and the moving device 80. Each of the above-described units is connected to the control device 50. The control device 50 controls each of the devices by performing transmission and reception of information between these devices.

Developer

The developer may be a single-component developer formed of only the toner, or may be a two-component developer formed of the toner and a carrier. Hereinafter, the toner will be described, and then the carrier will be described.

Toner

The toner has toner particles. The toner may have an external additive, if necessary.

Each of the toner particles has a sea and island structure which has a sea portion containing a binder resin and an island portion containing a release agent. That is, the toner particle has the sea and island structure in which the release agent exists in a continuous phase of the binder resin so as to have an island shape. The release agent domain may not exist at the center portion (centroid portion) of the toner particle in observation of a cross-section of the toner particle, preferably, from a viewpoint of prevention of occurrence of offset.

In the toner particle having the sea and island structure, the maximum frequent value in distribution of eccentricity B of the release agent domain (island portion containing the release agent) is from 0.75 to 0.95, and, from a viewpoint of prevention of the occurrence of offset, is preferably from 0.80 to 0.95, more preferably from 0.80 to 0.90, most preferably from 0.85 to 0.90.

The skewness in the distribution of the eccentricity B of the release agent domain (island portion containing the release agent) is in a range of from −1.10 to −0.50, and from a viewpoint of prevention of the occurrence of offset, the skewness is preferably in a range of from −1.00 to −0.60, and more preferably in a range of from −0.95 to −0.65.

A kurtosis in the distribution of the eccentricity B of the release agent domain (island portion containing the release agent) is, from a viewpoint of prevention of the occurrence of offset, preferably from −0.20 to +1.50, more preferably from −0.15 to +1.40, further preferably from −0.10 to +1.40, most preferably from −0.10 to +1.30.

The kurtosis is an index indicating a sharp point of a vertex (that is, the maximum frequent value in the distribution) in the distribution of the eccentricity B. The kurtosis being in the above range indicates a state where an apex portion (maximum frequent value) is not excessively sharp in the distribution of the eccentricity B and the distribution having an apex portion which is sharp and appropriately curved is made. For this reason, an appropriate amount of embedding of the external additive to the toner particles is easily maintained and a change of image density over a time is more prevented.

A confirming method of the sea and island structure of the toner will be described.

The sea and island structure of the toner is confirmed, for example, by a method of observing a cross-section of the toner (toner particle) using a transmission electron microscope, or a method of dyeing a cross-section of the toner particle with ruthenium tetroxide and observing the dyed cross-section using a scanning electron microscope. The method of observation using a scanning electron microscope is preferable in that the release agent domain in the cross-section of the toner may be observed more clearly. As the scanning electron microscope, a model which has been known well to those skilled in the related art may be used. For example, SU8020 manufactured by Hitachi High-Technologies Corporation, JSM-7500F manufactured by JEOL Ltd., and the like are included.

Specifically, an observing method is performed as follows. First, a toner (toner particle) to be measured is embedded in an epoxy resin, and then the epoxy resin is cured. This cured substance is cut into a thin section with a microtome including a diamond blade to thereby obtain an observation sample in which a cross-section of the toner is exposed. Dyeing with ruthenium tetroxide is performed on the thin observation sample and the cross-section of the toner is observed by using a scanning electron microscope. Using this observing method, a sea and island structure in which a release agent having a brightness difference (contrast) caused by a dyeing degree with respect to a continuous phase of a binder resin exists so as to have an island shape in the cross-section of the toner is observed.

Next, a measuring method of the eccentricity B of the release agent domain will be described.

The eccentricity B of the release agent domain is measured as follows. First, an image is recorded at magnification which allows a cross-section of one toner (toner particle) to come in sight, by using the confirming method of the sea and island structure. Image analysis for the recorded image is performed under a condition of 0.010000 μm/pixel by using image analysis software (WinROOF manufactured by MITANI Corporation). A shape of the cross-section of the toner is extracted by this image analysis by using a brightness difference (contrast) between the epoxy resin used in embedding and the binder resin of the toner. A projected area is obtained based on the extracted shape of the cross-section of the toner. An equivalent circle diameter is obtained from the projected area. The equivalent circle diameter is calculated by an expression of $2\sqrt{(\text{projected area}/\pi)}$. The obtained equivalent circle diameter is set as an equivalent circle diameter D of the toner in observation of the cross-section of the toner.

A centroid position is obtained based on the extracted shape of the cross-section of the toner. Subsequently, a shape of the release agent domain is extracted by using a brightness difference (contrast) between the binder resin and the release agent, and a centroid position of the release agent domain is obtained. Each of the centroid positions is obtained as follows. x coordinates of the centroids are values obtained by dividing summation of $x_i$ coordinate values by n, and y coordinates of the centroids are values obtained by dividing summation of $y_i$ coordinate values by n, when the number of pixels in an area of the extracted toner or the extracted release agent domain is set as n, xy coordinates of each pixel are set as $x_i$ and $y_i$ (i=1, 2, . . . , n). A distance between the centroid position of the cross-section of the toner and the centroid position of the release agent domain is obtained. The obtained distance is set as a distance d from the centroid of the toner to the centroid of the island portion containing the release agent in observation of the cross-section of the toner.

At last, the eccentricity B of the release agent domain is obtained based on each of the equivalent circle diameter D and the distance d by using Expression (1) (eccentricity B=2d/D). Similarly, the above-described operation is performed on each of plural release agent domains in the cross-section of one toner (toner particle) and thereby the eccentricity B of the release agent domain is obtained.

Next, a calculating method of the maximum frequent value in distribution of the eccentricity B of the release agent domain will be described.

First, the eccentricity B of the release agent domain for 200 toners (toner particles) is measured as described above. Data of the obtained eccentricity B of each of the release agent domains is subjected to statistical analysis processing in a data sections from 0 in increment of 0.01, and thereby the distribution of the eccentricity B is obtained. The maximum frequent value in the obtained distribution, that is, a value of a data section which appears most in the distribution of the eccentricity B of the release agent domain is obtained. The value of this data section is set as the maximum frequent value in the distribution of the eccentricity B of the release agent domain.

Next, a calculating method of the skewness in the distribution of the eccentricity B of the release agent domain will be described.

First, the distribution of the eccentricity B of the release agent domain is obtained as described above. The skewness in the distribution of the eccentricity B is obtained based on the following expression. In the following expression, the skewness is set as Sk, the number of pieces of data of the eccentricity B of the release agent domain is set as n, values of data of the eccentricity B of the respective release agent domains are set as $x_i$ (i=1, 2, . . . , n), an average value of all pieces of data of the eccentricity B of the release agent domain is set as x (x with a bar above), and a standard deviation of all pieces of data of the eccentricity B of the release agent domain is set as s.

$$Sk = \frac{n}{(n-1)(n-2)} \sum_{i=1}^{n} \left( \frac{x_i - \bar{x}}{s} \right)^3$$

Next, a calculating method of the kurtosis in the distribution of the eccentricity B of the release agent domain will be described.

First, the distribution of the eccentricity B of the release agent domain is obtained as described above. The kurtosis in the obtained distribution of the eccentricity B is obtained based on the following expression. In the following expression, the kurtosis is set as Ku, the number of pieces of data of the eccentricity B of the release agent domain is set as n, values of data of the eccentricity B of the respective release agent domains are set as $x_i$ (i=1, 2, . . . , n), an average value of all pieces of data of the eccentricity B of the release agent domain is set as x (x with a bar above), and a standard deviation of all pieces of data of the eccentricity B of the release agent domain is set as s.

$$Ku = \frac{n(n+1)}{(n-1)(n-2)(n-3)} \sum_{i=1}^{n} \left( \frac{x_i - \bar{x}}{s} \right)^4 - \frac{3(n-1)^2}{(n-2)(n-3)}$$

Regarding a method for satisfying distribution characteristics of the eccentricity B of the release agent domain in a toner particle, it will be described in a method of preparing the toner particles.

Components of the toner particle will be described below.

The toner particle contains a binder resin, a colorant, and a release agent.

Binder Resin

Examples of the binder resin include vinyl resins formed of homopolymers of monomers such as styrenes (for example, styrene, parachlorostyrene, and α-methylstyrene), (meth) acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, laurylmethacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more types of these monomers.

Examples of the binder resin also include a non-vinyl resin such as an epoxy resin, a polyester resin, a polyurethane resin, a polyamide resin, a cellulose resin, a polyether resin, and modified rosin, mixtures thereof with the above-described vinyl resin, or graft polymer obtained by polymerizing a vinyl monomer with the coexistence of such non-vinyl resins.

These binder resins may be used singly or in combination of two or more kinds thereof.

As the binder resin, a polyester resin is appropriate.

As the polyester resin, for example, a well-known polyester resin is included.

Examples of the polyester resin include condensation polymers of polyvalent carboxylic acids and polyols. A commercially available product or a synthesized product may be used as the polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, from 1 to 5 carbon atoms) thereof. Among these substances, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more types thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more types thereof.

The glass transition temperature (Tg) of the polyester resin is preferably from 50° C. to 80° C., and more preferably from 50° C. to 65° C.

The glass transition temperature is obtained by a DSC curve which is obtained by a differential scanning calorimetry (DSC), and more specifically, is obtained by "Extrapolating Glass Transition Starting Temperature" disclosed in a method for obtaining the glass transition temperature of "Testing Methods for Transition Temperatures of Plastics" in JIS K-7121-1987.

The polyester resin is obtained by a known preparing method. Specific examples thereof include a method of performing a reaction at a polymerization temperature set to be in a range of from 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is performed while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is, for example, preferably in a range of from 40% by weight to 95% by weight, more preferably in a range of from 50% by weight to 90% by weight, and further preferably in a range of from 60% by weight to 85% by weight relative to the entire toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorant may be used singly or in combination of two or more types thereof.

If necessary, the colorant may be surface-treated or used in combination with a dispersing agent. Plural kindes of colorants may be used in combination.

The content of the colorant is, for example, preferably in a range of from 1% by weight to 30% by weight, and more preferably in a range of from 3% by weight to 15% by weight relative to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters; and the like. The release agent is not limited to these examples.

Among these substances, as the release agent, the hydrocarbon wax (waxes having hydrocarbon as a skeleton) is preferable. The hydrocarbon wax is appropriate because the release agent domain is easily formed and rapid bleeding to the surface of the toner particle easily occurs in fixing.

The content of the release agent is, for example, preferably in a range of from 1% by weight to 20% by weight, and more preferably in a range of from 5% by weight to 15% by weight relative to the entire toner particles.

Other Additives

Examples of other additives include known additives such as a magnetic material, a charge controlling agent, and inorganic powder. The toner particles contain these additives as internal additives.

Characteristics of Toner Particles

The toner particles may be toner particles having a single-layer structure, or be toner particles having a so-called core/shell structure composed of a core (core particle) and a coating layer (shell layer) coated on the core.

Here, toner particles having a core/shell structure is preferably composed of, for example, a core containing a binder resin, a colorant and a release agent, and a coating layer containing a binder resin.

The volume average particle diameter (D50v) of the toner particles is preferably in a range of from 2 μm to 10 μm, and more preferably in a range of from 4 μm to 8 μm.

Various average particle diameters and various particle size distribution indices of the toner particles are measured by using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to from 100 ml to 150 ml of the electrolyte.

The electrolyte in which the sample is suspended is subjected to a dispersion treatment using an ultrasonic disperser for 1 minute, and a particle size distribution of particles having a particle diameter of from 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles as an external additive are preferably subjected to a hydrophobizing treatment with a hydrophobizing agent. The treatment with a hydrophobizing agent is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used singly or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, polymethyl methacrylate (PMMA), and melamine resin particles) and a cleaning aid (for example, metal salt of higher fatty acid represented by zinc stearate, and fluorine polymer particles).

The amount of the external additive externally added is, for example, preferably in a range of from 0.01% by weight to 5% by weight, and more preferably in a range of from 0.01% by weight to 2.0% by weight relative to the toner particles.

Method of Preparing Toner

Next, a method of preparing the toner will be described.

The toner is obtained by externally adding an external additive to toner particles after preparing the toner particles.

The toner particles may be prepared using any of a dry preparing method (for example, kneading and pulverizing method) and a wet preparing method (for example, aggregation and coalescence method, suspension and polymerization method, and dissolution and suspension method). The toner particle preparing method is not particularly limited to these preparing methods, and a known preparing method is employed.

Among these methods, the toner particles may preferably be obtained by the aggregation and coalescence method.

For preparing the toner (toner particle) which satisfies the above-described distribution characteristics of the eccentricity B of the release agent domain as described above, the toner particle may preferably be prepared by an aggregation and coalescence method described below.

Specifically, the toner particle is preferably prepared by processes as follows: a process of preparing each dispersion (dispersion preparation process); a process (first aggregated particle forming process); a process (second aggregated particle forming process); and a process (coalescence process). In the first aggregated particle forming process, particles are aggregated in a dispersion obtained by mixing a first resin particle dispersion and a colorant particle dispersion, and thereby first aggregated particles are formed. The first resin particle dispersion is obtained by dispersing first resin particles corresponding to the binder resin, and the colorant particle dispersion is obtained by dispersing particles of the colorant (also referred to as "colorant particles" below). In the second aggregated particle forming process, a dispersion mixture in which second resin particles corresponding to the binder resin and particles of the release agent (also referred to as "release agent particles" below) are dispersed is prepared. After a first aggregated particle dispersion in which the first aggregated particles are dispersed is prepared, the dispersion mixture is sequentially added to the first aggregated particle dispersion while the concentration of the release agent particles in the dispersion mixture gradually increases. Thus, the second resin particles and the release agent particles are aggregated on a surface of the first aggregated particles, and thereby second aggregated particles are formed. In the coalescence process, a second aggregated particle dispersion in which the second aggregated particles are dispersed is heated to coalesce the second aggregated particles, and thereby toner particles are formed.

The method of preparing the toner particle is not limited to the above descriptions. For example, particles are aggregated in a dispersion mixture obtained by mixing the resin particle dispersion and the colorant particle dispersion. Then, a release agent particle dispersion is added to the dispersion mixture in the process of aggregation while increasing an addition speed gradually or while increasing the concentration of the release agent particles increases. Thus, aggregation of particles proceeds more, and thereby aggregated particles are formed. The toner particles may be formed by coalescing the aggregated particles.

The processes will be described below in detail.

Preparation Process of Dispersion

First, respective dispersions are prepared by using an aggregation and coalescence method. Specifically, a first resin particle dispersion in which first resin particles corresponding to the binder resin are dispersed, a colorant particle dispersion in which colorant particles are dispersed, a second resin particle dispersion in which second resin particles corresponding to the binder resin are dispersed, and a release agent particle dispersion in which release agent particles are dispersed are prepared.

In the dispersion preparation process, descriptions will be made, referring the first resin particles and the second resin particles to as "resin particles" collectively.

The resin particle dispersion is prepared by, for example, dispersing resin particles in a dispersion medium using a surfactant.

Examples of the dispersion medium used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as a sulfuric ester salt, a sulfonate, a phosphate ester, and a soap; cationic surfactants such as an amine salt and a quaternary ammonium salt; and nonionic surfactants such as polyethylene glycol, an ethylene oxide adduct of alkyl phenol, and polyol. Among these, anionic surfactants and cationic surfactants are particularly preferably used. Nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO mill having media is exemplified. Depending on the kind of the resin particles, resin particles may be dispersed in the resin particle dispersion according to, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

A volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement with a laser diffraction-type particle size distribution measuring device (for example, LA-700 manufactured by Horiba, Ltd.), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

First Aggregated Particle Forming Process

Next, the first resin particle dispersion and the colorant particle dispersion are mixed together.

The first resin particles and the colorant particles are heterogeneously aggregated in the dispersion mixture, and thereby first aggregated particles including first resin particles and colorant particles are formed.

Specifically, for example, an aggregating agent is added to the dispersion mixture and a pH of the dispersion mixture is adjusted to be acidic (for example, the pH is from 2 to 5). If necessary, a dispersion stabilizer is added. Then, the dispersion mixture is heated at the glass transition temperature of the first resin particles (specifically, for example, from a temperature 30° C. lower than the glass transition temperature of the first resin particles to a temperature 10° C. lower than the glass transition temperature thereof) to aggregate the particles dispersed in the dispersion mixture, and thereby the first aggregated particles are formed.

In the first aggregated particle forming process, for example, the aggregating agent may be added at room temperature (for example, 25° C.) under stirring of the dispersion mixture using a rotary shearing-type homogenizer, the pH of the dispersion mixture may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, and a bi- or higher-valent metal complex. Particularly, when a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

Examples of the inorganic metal salt include a metal salt such as calcium chloride, calcium nitrate, barium chloride, magnesium chloride, zinc chloride, aluminum chloride, and aluminum sulfate, and inorganic metal salt polymer such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

An addition amount of the chelating agent is, for example, preferably in a range of from 0.01 parts by weight to 5.0 parts by weight, and more preferably in a range of from 0.1 parts by weight to less than 3.0 parts by weight relative to 100 parts by weight of the first resin particles.

Second Aggregated Particle Forming Process

Next, after the first aggregated particle dispersion in which the first aggregated particles are dispersed is obtained, a dispersion mixture in which the second resin particles and the release agent particles are dispersed is sequentially added to the first aggregated particle dispersion while increasing the concentration of the release agent particles in the dispersion mixture gradually.

The second resin particles may be the same type as or a different type or from the first resin particles.

The second resin particles and the release agent particles are aggregated on surfaces of the first aggregated particles in a dispersion in which the first aggregated particles, the second resin particles, and the release agent particles are dispersed. Specifically, for example, in the first aggregated particle forming process, when a particle diameter of the first aggregated particle reaches a desired particle diameter, a dispersion mixture in which the second resin particles and the release agent particles are dispersed is added to the first aggregated particle dispersion while increasing the concentration of the release agent particles gradually. The dispersion is heated at a temperature which is equal to or less than the glass transition temperature of the second resin particles.

For example, the pH of the dispersion is substantially in a range of from 6.5 to 8.5, and thus the progress of the aggregation is stopped.

Aggregated particles in which the second resin particles and the release agent particles are attached to the surfaces of the first aggregated particles are formed through this process. That is, second aggregated particles in which aggregates of the second resin particles and the release agent particles are attached to the surfaces of the first aggregated particles are formed. At this time, since the dispersion mixture in which the second resin particles and the release agent particles are dispersed is sequentially added to the first aggregated particle dispersion while increasing the concentration of the release agent particles in the dispersion mixture gradually, the concentration (abundance ratio) of the release agent particles becomes gradually larger toward the radially outside direction of the particles, and the aggregates of the second resin particles and the release agent particles are attached to the surface of the first aggregated particle.

As a method of adding the dispersion mixture, a power feeding addition method may preferably be used. The dispersion mixture may be added to the first aggregated particle dispersion, with a gradual increase of the concentration of the release agent particles in the dispersion mixture, by using the power feeding addition method.

The method of adding the dispersion mixture using the power feeding addition method will be described with reference to the drawing.

Figure 4:
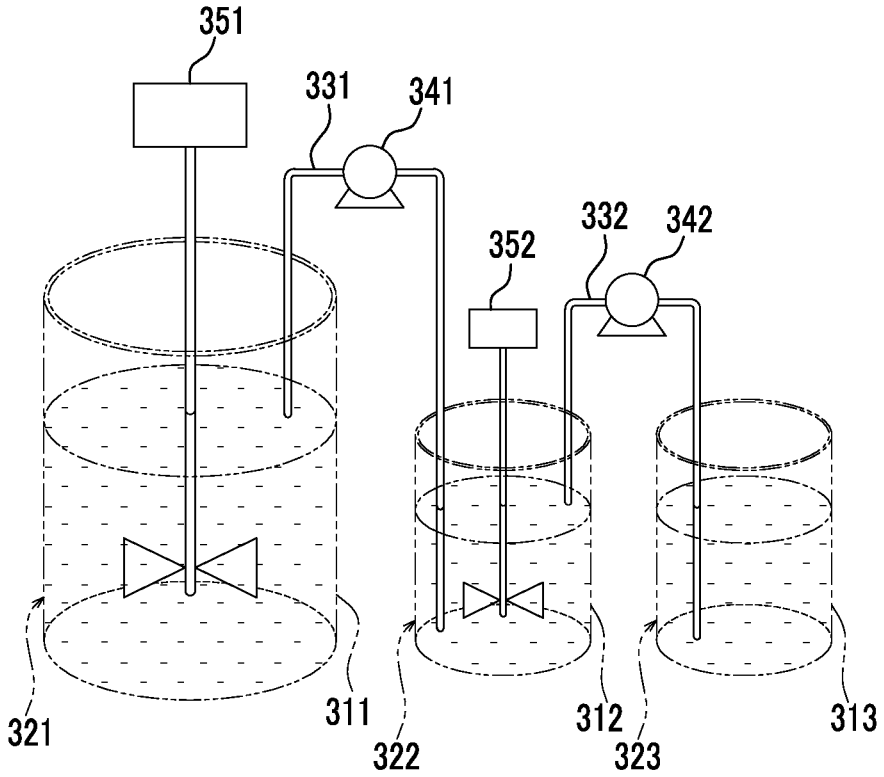
FIG. 4 is a schematic diagram illustrating a power feeding addition method.

FIG. 4 illustrates an apparatus used in the power feeding addition method. In FIG. 4, the reference numeral 311 indicates the first aggregated particle dispersion, the reference numeral 312 indicates the second resin particle dispersion, the reference numeral 313 indicates the release agent particle dispersion.

The apparatus illustrated in FIG. 4 includes a first storage tank 321, a second storage tank 322, and a third storage tank 323. In the first storage tank 321, the first aggregated particle dispersion in which the first aggregated particles are dispersed is stored. In the second storage tank 322, the second resin particle dispersion in which the second resin particles are dispersed is stored. In the third storage tank 323, the release agent particle dispersion in which the release agent particles are dispersed is stored.

The first storage tank 321 and the second storage tank 322 are linked to each other by using a first liquid transport tube 331. A first liquid transport pump 341 is provided in the middle of a path of the first liquid transport tube 331. Driving of the first liquid transport pump 341 causes the dispersion stored in the second storage tank 322 to be transported to the dispersion stored in the first storage tank 321 through the first liquid transport tube 331.

A first stirring apparatus 351 is disposed in the first storage tank 321. When driving of the first stirring apparatus 351 causes the dispersion stored in the second storage tank 322 to be transported to the dispersion stored in the first storage tank 321, the dispersions in the first storage tank 321 are stirred and mixed.

The second storage tank 322 and the third storage tank 323 are linked to each other by using a second liquid transport tube 332. A second liquid transport pump 342 is provided in the middle of a path of the second liquid transport tube 332. Driving of the second liquid transport pump 342 causes the dispersion stored in the third storage tank 323 to be transported to the dispersion stored in the second storage tank 322 through the second liquid transport tube 332.

A second stirring apparatus 352 is disposed in the second storage tank 322. When driving of the second stirring apparatus 352 causes the dispersion stored in the third storage tank 323 to be transported to the dispersion stored in the second storage tank 322, the dispersions in the second storage tank 322 are stirred and mixed.

In the apparatus illustrated in FIG. 4, first, the first aggregated particle forming process is performed and thereby a first aggregated particle dispersion is prepared, in the first storage tank 321. The first aggregated particle dispersion is stored in the first storage tank 321. The first aggregated particle forming process may be performed and thereby the first aggregated particle dispersion may be prepared in another tank, and then, the first aggregated particle dispersion may be stored in the first storage tank 321.

In this state, the first liquid transport pump 341 and the second liquid transport pump 342 are driven. This driving causes the second resin particle dispersion stored in the second storage tank 322 to be transported to the first aggregated particle dispersion stored in the first storage tank 321. Driving of the first stirring apparatus 351 causes the dispersions in the first storage tank 321 to be stirred and mixed.

The release agent particle dispersion stored in the third storage tank 323 is transported to the second resin particle dispersion stored in the second storage tank 322. Driving of the second stirring apparatus 352 causes the dispersions in the second storage tank 322 to be stirred and mixed.

At this time, the release agent particle dispersion is sequentially transported to the second resin particle dispersion stored in the second storage tank 322, and thus the concentration of the release agent particles becomes higher gradually. For this reason, the dispersion mixture in which second resin particles and the release agent particles are dispersed is stored in the second storage tank 322, and this dispersion mixture is transported to the first aggregated particle dispersion stored in the first storage tank 321. The dispersion mixture is continuously transported with an increase of the concentration of the release agent particle dispersion in the dispersion mixture.

In this manner, the dispersion mixture in which the second resin particles and the release agent particles are dispersed may be added to the first aggregated particle dispersion with a gradual increase of the concentration of the release agent particles, by using the power feeding addition method.

In the power feeding addition method, the distribution characteristics of the release agent domain of the toner are adjusted by adjusting liquid transport starting time and a liquid transport speed for each of the dispersions which are respectively stored in the second storage tank 322 and the third storage tank 323. In the power feeding addition method, also by adjusting the liquid transport speed in the process of transporting of the dispersions respectively stored in the second storage tank 322 and the third storage tank 323, the distribution characteristics of the release agent domain of the toner are adjusted.

Specifically, for example, the maximum frequent value in the distribution of the eccentricity B of the release agent domain is adjusted depending on a period of time when transporting of the release agent particle dispersion to the second storage tank 322 from the third storage tank 323 is ended. More specifically, for example, if transporting of the release agent particle dispersion to the second storage tank 322 from the third storage tank 323 is ended before liquid transporting to the first storage tank 321 from the second storage tank 322 is ended, the concentration of the release agent particles in the dispersion mixture of the second storage tank 322 does not increase from that point of time. Thus, the maximum frequent value in the distribution of the eccentricity B of the release agent domain becomes smaller.

For example, the skewness in the distribution of the eccentricity B of the release agent domain is adjusted depending on a period of time when the dispersions are respectively transported from the second storage tank 322 and the third storage tank 323, and a liquid transport speed at which the dispersion is transported to the first storage tank 321 from the second storage tank 322. More specifically, for example, if a liquid transport starting time of the release agent particle dispersion from the third storage tank 323 and a liquid transport starting time of the dispersion from the second storage tank 322 are early, and the liquid transport speed of the dispersion from the second storage tank 322 is lowered, a state where the release agent particles are disposed from a further inner side of the formed aggregated particle to a further outer side thereof is realized. Thus, the skewness in the distribution of the eccentricity B of the release agent domain becomes greater.

For example, the kurtosis in the distribution of the eccentricity B of the release agent domain is adjusted by changing the liquid transport speed of the release agent particle dispersion from the third storage tank 323 in the process of liquid transport. More specifically, for example, if only the liquid transport speed of the release agent particle dispersion from the third storage tank 323 becomes faster in the process of liquid transport, the concentration of the release agent particles in the dispersion of the second storage tank 322 becomes higher from that time. For this reason, there arises a state where many of the release agent particles are disposed in a certain area (certain deep portion) in a radial direction of the aggregated particle in the formed aggregated particle. Thus, the kurtosis in the distribution of the eccentricity B of the release agent domain becomes greater.

The above-described power feeding addition method is not limited to the above method. For example, various methods may be employed. Examples of the various methods include a method in which, a storage tank storing the second resin particle dispersion and a storage tank storing a dispersion mixture in which the second resin particles and the release agent particles are dispersed are separately provided and the respective dispersions are transported to the first storage tank 321 from the respective storage tanks while changing the liquid transport speed, a method in which a storage tank storing the release agent particle dispersion and a storage tank storing a dispersion mixture in which the second resin particles and the release agent particles are dispersed are separately provided, and the respective dispersions are transported to the first storage tank 321 from the respective storage tanks while changing the liquid transport speed, and the like.

As described above, the second aggregated particles in which the second resin particles and the release agent particles are attached to the surfaces of the first aggregated particles and aggregated are obtained.

Coalescence Process

Next, the second aggregated particle dispersion in which the second aggregated particles are dispersed is heated at, for example, a temperature that is equal to or higher than the glass transition temperature of the first and second resin particles (for example, a temperature that is higher than the glass transition temperature of the first and second resin particles by 10° C. to 30° C.) to coalesce the second aggregated particles and form toner particles.

The toner particles are obtained through the above-described processes.

Incidentally, toner particles may be prepared through the following processes of: after the second aggregated particle dispersion, in which the second aggregated particles are dispersed, is obtained, further mixing the second aggregated particle dispersion with a third resin particle dispersion in which third resin particles corresponding to the binder resin are dispersed to perform aggregation so that the third resin particles further adhere to the surfaces of the second aggregated particles, thereby forming third aggregated particles; and coalescing the third aggregated particles by heating the third aggregated particle dispersion in which the third aggregated particles are dispersed, and thereby forming toner particles having a core/shell structure.

In the toner particle (toner) obtained by this operation, the maximum frequent value in the distribution of the eccentricity B of the release agent domain is less than 1.00.

After the coalescence process is ended, toner particles formed in a solution are subjected to a well-known washing process, a well-known solid-liquid separation process, and a well-known drying process, and thereby dried toner particles are obtained.

Regarding the washing process, displacement washing using ion exchanged water may preferably be sufficiently performed for charging property. The solid-liquid separation process is not particularly limited, but suction filtration, pressure filtration, or the like may preferably be performed for productivity. The drying process is not particularly limited, but freeze drying, flash jet drying, fluidized drying, vibrating fluidized drying, and the like may preferably be performed for productivity.

The toner is prepared, for example, by adding an external additive to the obtained toner particles in a dried state, and performing mixing. The mixing may be performed, for example, by using a V blender, a HENSCHEL mixer, a Lödige mixer, or the like. Furthermore, if necessary, coarse toner particles may be removed using a vibration sieving machine, a wind classifier, or the like.

Carrier

The carrier is not particularly limited, and known carriers may be used. Examples of the carrier include a coated carrier in which surface of core formed of a magnetic powder is coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores which are coated with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as conductive particles.

Examples of the conductive particles include particles of metal such as gold, silver, and copper, and particles of carbon black, titanium oxide, zinc oxide, tin oxide, barium sulfate, aluminum borate, potassium titanate, and the like.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

EXAMPLES

This exemplary embodiment will be described more specifically in detail by using examples and comparative examples. However, this exemplary embodiment is not limited these examples. A "part" means a "part by weight" unless otherwise indicated.

Preparation of Resin Particle Dispersion

Preparation of Resin Particle Dispersion (1)

30 parts by mol of terephthalic acid, 70 parts by mol of fumaric acid, 5 parts by mol of an ethylene oxide adduct of bisphenol A, and 95 parts by mol of a propylene oxide adduct of bisphenol A are put into a 5-liter flask provided with a stirrer, a nitrogen inlet tube, a thermometer, and a rectifying column. The temperature of the flask is increased up to 210° C. over one hour, and 1 part of titanium tetraethoxide relative to 100 parts of the materials is put into the flask. The temperature is increased up to 230° C. over 0.5 hours while generated water is distilled away. After a dehydration condensation reaction is continued at that temperature for one hour, the reactant is cooled. In this manner, Polyester resin (1) having a weight-average molecular weight of 18,500, an acid value of 14 mgKOH/g, and a glass transition temperature of 59° C. is synthesized.

40 parts of ethyl acetate and 25 parts of 2-butanol are put into a container provided with a temperature adjusting unit and a nitrogen substituting unit to obtain a mixed solvent. Then, 100 parts of Polyester resin (1) are slowly put into the mixed solvent to thereby be dissolved. 10% by weight of an ammonia aqueous solution (having an amount corresponding to three times an acid value of the resin in a molar ratio) is put into the obtained mixture, followed by stirring for 30 minutes.

Then, substitution with dry nitrogen is performed in the container, and the temperature is held at 40° C. 400 parts of ion-exchanged water are dropped into the liquid mixture at a speed of 2 parts/minute while stirring to prepare an emulsion. After dropping is ended, the temperature of the emulsion is returned to the room temperature (20° C. to 25° C.), and bubbling is performed for 48 hours by using dry nitrogen while stirring such that ethyl acetate and 2-butanol are reduced to be equal to or less than 1,000 ppm. Thus, a resin particle dispersion in which resin particles having a volume average particle diameter of 200 nm are dispersed is obtained. Ion-exchanged water is added to the resin particle dispersion so as to adjust a solid content to be 20% by weight, and the obtained dispersion is used as Resin particle dispersion (1).

Preparation of Colorant Particle Dispersion

Preparation of Colorant Particle Dispersion (1)

70 parts of a cyan pigment: C.I. Pigment Blue 15:3 (copper phthalocyanine, product manufactured by DIC Corporation, product name: FASTOGEN BLUE LA5380), 5 parts of anionic surfactant (NEOGEN RK, product manufactured by DKS Co., Ltd.), and 200 parts of ion-exchanged water are mixed with each other, and are dispersed by using a homogenizer (ULTRA-TURRAX T50, product manufactured by IKA Corporation) for 10 minutes. Ion-exchanged water is added so as to cause a solid content in the dispersion to be 20% by weight, and thereby Colorant particle dispersion (1) in which colorant particles having a volume average particle diameter of 190 nm are dispersed is obtained.

Preparation of Release Agent Particle Dispersion

Preparation of Release Agent Particle Dispersion (1)

100 parts of a paraffin wax (HNP-9, product manufactured by NIPPON SEIRO Co., Ltd.), 1 part of an anionic surfactant (NEOGEN RK, product manufactured by DKS Co., Ltd.), 350 parts of ion-exchanged water are mixed with each other, heated up to 100°, and dispersed by using a homogenizer (ULTRA-TURRAX T50, product manufactured by IKA Corporation). Then, dispersing is performed by using a Manton-Gaulin high-pressure homogenizer (product manufactured by Gaulin Corporation), to thereby obtain Release agent particle dispersion (1) (solid content of 20% by weight) in which release agent particles having a volume average particle diameter of 200 nm are dispersed.

Example 1

Preparation of Toner Particle

An apparatus (see FIG. 4) having the following configuration is prepared: a round stainless steel flask and a container A are connected to each other by using a tube pump A; driving of the tube pump A causes a liquid stored in the container A is transported to the flask; the container A and a container B are connected to each other by using a tube pump B; driving of the tube pump B causes a liquid stored in the container B to be transported to the container A. The following operations are performed by using this apparatus.

500 parts of Resin particle dispersion (1), 40 parts of Colorant particle dispersion (1), and 2 parts of an anionic surfactant (TAYCAPOWER) are put into a round stainless steel flask, and 0.1 N nitric acid is added to the liquid so as to adjust the pH of the liquid to 3.5. Then, 30 parts of a nitric acid aqueous solution in which a concentration of polyaluminum chloride is 10% by weight are added thereto. Subsequently, the obtained mixture is dispersed at 30° C. by using a homogenizer (ULTRA-TURRAX T50, product manufactured by IKA Corporation), and then, the temperature of the obtained dispersion is increased at a pace of 1° C./30 minutes in an oil bath for heating to thereby increase a particle diameter of aggregated particles.

150 parts of Resin particle dispersion (1) are put into the container A which is a bottle made of a polyester, and 25 parts of Release agent particle dispersion (1) are put into the container B which is a bottle made of a polyester. Then, a liquid transport speed of the tube pump A is set to 0.70 parts/1 minute, and a liquid transport speed of the tube pump B is set to 0.14 parts/1 minute. The tube pumps A and B are driven from a point of time when the temperature of the inside of the round stainless steel flask in the process of forming of the aggregated particle reaches 37.0° C., and thus transporting of the respective dispersions is started. Accordingly, a dispersion mixture in which resin particles and release agent particles are dispersed is transported from the container A to the round stainless steel flask which is in the process of forming of the aggregated particle, with a gradual increase of the concentration of the release agent particles.

The content of the flask is held for 30 minutes from a point of time when the temperature of the inside of the flask is 48° C. after transporting of the dispersions to the flask is ended, and thereby second aggregated particles are formed.

Then, 50 parts of Resin particle dispersion (1) are added slowly and the obtained mixture is held for 1 hour. 0.1 N sodium hydroxide aqueous solution is added thereto to thereby adjust the pH of the mixture to 8.5. Then, heating is performed up to 85° C. with continuous stirring, and the resultant is held for 5 hours. Then, the resultant is cooled to 20° C. at a speed of 20° C./minute, is filtered, is sufficiently washed by using ion-exchanged water, and then is dried. Thus, Toner particles (1) having a volume average particle diameter of 6.0 μm are obtained.

Preparation of Toner (1)

100 parts of Toner particle (1), 0.7 parts of dimethyl silicone oil-treated silica particles (RY200, product manufactured by NIPPON AEROSIL CO., LTD.) are mixed with each other by using a HENSCHEL mixer (peripheral speed of 30 m/s, 3 minutes), and thereby Toner (1) is obtained.

Preparation of Developer (1)

Among 100 parts of ferrite particles (average particle diameter of 50 μm), 14 parts of toluene, 3 parts of a styrene/methyl methacrylate copolymer (copolymerization ratio: 15/85), and 0.2 parts of carbon black, the components except for the ferrite particles are dispersed in a sand mill to thereby prepare a dispersion. This dispersion and the ferrite particles are put into a vacuum degassing kneader. Decompression and drying is performed with stirring to thereby obtain a carrier.

8 parts of Toner (1) are mixed with 100 parts of the carrier, and thereby Developer (1) is obtained.

Example 2

Toner particles (2) are obtained in the same manner as in preparing of Toner particles (1) in Example 1 except that the liquid transport speed of the tube pump A is set to 0.55 parts/1 minute, the liquid transport speed of the tube pump B is set to 0.11 parts/1 minute and the tube pumps A and B are driven from a point of time when the temperature of the inside of the flask reaches 33.0° C. Toner particles (2) have a volume average particle diameter of 5.9 μm. Toner (2) and Developer (2) are prepared by using Toner particles (2) in the same manner as in Example 1.

Example 3

Toner particles (3) are obtained in the same manner as in preparing of Toner particles (1) in Example 1 except that the liquid transport speed of the tube pump A is set to 0.80 parts/1 minute, the liquid transport speed of the tube pump B is set to 0.16 parts/1 minute and the tube pumps A and B are driven from a point of time when the temperature of the inside of the flask reaches 35.0° C. Toner particles (3) have a volume average particle diameter of 5.3 μm. Toner (3) and Developer (3) are prepared by using Toner particles (3) in the same manner as in Example 1.

Comparative Example 1

Toner particles (4) are obtained in the same manner as in preparing of Toner particles (1) in Example 1 except that the liquid transport speed of the tube pump A is set to 0.58 parts/1 minute, the liquid transport speed of the tube pump B is set to 0.11 parts/1 minute and the tube pumps A and B are driven from a point of time when the temperature of the inside of the flask reaches 39.0° C. Toner particles (4) have a volume average particle diameter of 5.6 μm. Toner (4) and Developer (4) are prepared by using Toner particles (4) in the same manner as in Example 1.

Example 2

Toner particles (5) are obtained in the same manner as in preparing of Toner particles (1) in Example 1 except that the liquid transport speed of the tube pump A is set to 0.84 parts/1 minute, the liquid transport speed of the tube pump B is set to 0.17 parts/1 minute and the tube pumps A and B are driven from a point of time when the temperature of the inside of the flask reaches 41.0° C. Toner particles (5) have a volume average particle diameter of 5.7 μm. Toner (5) and Developer (5) are prepared by using Toner particles (5) in the same manner as in Example 1.

Comparative Example 3

Toner particles (C1) are obtained in the same manner as in preparing of Toner particles (1) in Example 1 except that the liquid transport speed of the tube pump A is set to 0.55 parts/1 minute, the liquid transport speed of the tube pump B is set to 0.11 parts/1 minute and the tube pumps A and B are driven from a point of time when the temperature of the inside of the flask reaches 30.0° C. Toner particles (C1) have a volume average particle diameter of 5.2 μm. Toner (C1) and Developer (C1) are prepared by using Toner particles (C1) in the same manner as in Example 1.

Comparative Example 4

Toner particles (C2) are obtained in the same manner as in preparing of Toner particles (1) in Example 1 except that the liquid transport speed of the tube pump A is set to 0.84 parts/1 minute, the liquid transport speed of the tube pump B is set to 0.17 parts/1 minute and the tube pumps A and B are driven from a point of time when the temperature of the inside of the flask reaches 33.0° C. Toner particles (C2) have a volume average particle diameter of 6.0 μm. Toner (C2) and Developer (C2) are prepared by using Toner particles (C2) in the same manner as in Example 1.

Comparative Example 5

Toner particles (C3) are obtained in the same manner as in preparing of Toner particles (1) in Example 1 except that the liquid transport speed of the tube pump A is set to 0.51 parts/1 minute, the liquid transport speed of the tube pump B is set to 0.10 parts/1 minute and the tube pumps A and B are driven from a point of time when the temperature of the inside of the flask reaches 31.0° C. Toner particles (C3) have a volume average particle diameter of 5.9 μm. Toner (C3) and Developer (C3) are prepared by using Toner particles (C3) in the same manner as in Example 1.

Comparative Example 6

Toner particles (C4) are obtained in the same manner as in preparing of Toner particles (1) in Example 1 except that the liquid transport speed of the tube pump A is set to 0.90 parts/1 minute, the liquid transport speed of the tube pump B is set to 0.19 parts/1 minute and the tube pumps A and B are driven from a point of time when the temperature of the inside of the flask reaches 35.0° C. Toner particles (C4) have a volume average particle diameter of 6.1 μm. Toner (C4) and Developer (C4) are prepared by using Toner particles (C4) in the same manner as in Example 1.

Comparative Example 7

Toner particles (C5) are obtained in the same manner as in preparing of Toner particles (1) in Example 1 except that the liquid transport speed of the tube pump A is set to 0.50 parts/1 minute, the liquid transport speed of the tube pump B is set to 0.10 parts/1 minute and the tube pumps A and B are driven from a point of time when the temperature of the inside of the flask reaches 38.0° C. Toner particles (C5) have a volume average particle diameter of 5.4 μm. Toner (C5) and Developer (C5) are prepared by using Toner particles (C5) in the same manner as in Example 1.

Comparative Example 8

Toner particles (C6) are obtained in the same manner as in preparing of Toner particles (1) in Example 1 except that the liquid transport speed of the tube pump A is set to 0.89 parts/1 minute, the liquid transport speed of the tube pump B is set to 0.19 parts/1 minute and the tube pumps A and B are driven from a point of time when the temperature of the inside of the flask reaches 42.0° C. Toner particles (C6) have a volume average particle diameter of 5.5 μm. Toner (C6) and Developer (C6) are prepared by using Toner particles (C6) in the same manner as in Example 1.

Example 4

Toner particles (6) are obtained in the same manner as in preparing of Toner particles (1) in Example 1 except that the liquid transport speed of the tube pump A is set to 0.75 parts/1 minute, the liquid transport speed of the tube pump B is set to 0.11 parts/1 minute and the tube pumps A and B are driven from a point of time when the temperature of the inside of the flask reaches 37.0° C., and at the time when the temperature of the inside of the flask reaches 40.0° C., the liquid transport speed of the tube pump B is changed to 0.19 parts/1 minute. Toner particles (6) have a volume average particle diameter of 5.9 μm. Toner (6) and Developer (6) are prepared by using Toner particles (6) in the same manner as in Example 1.

Example 5

Toner particles (7) are obtained in the same manner as in preparing of Toner particles (1) in Example 1 except that the liquid transport speed of the tube pump A is set to 0.75 parts/1 minute, the liquid transport speed of the tube pump B is set to 0.14 parts/1 minute and the tube pumps A and B are driven from a point of time when the temperature of the inside of the flask reaches 35.0° C., and at the time when the temperature of the inside of the flask reaches 39.0° C., the liquid transport speed of the tube pump B is changed to 0.10 parts/1 minute. Toner particles (7) have a volume average particle diameter of 5.9 μm. Toner (7) and Developer (7) are prepared by using Toner particles (7) in the same manner as in Example 1.

Example 6

Toner particles (R1) are obtained in the same manner as in preparing of Toner particles (1) in Example 1 except that the liquid transport speed of the tube pump A is set to 0.75 parts/1 minute, the liquid transport speed of the tube pump B is set to 0.11 parts/1 minute and the tube pumps A and B are driven from a point of time when the temperature of the inside of the flask reaches 35° C., and at the time when the temperature of the inside of the flask reaches 40° C., the liquid transport speed of the tube pump B is changed to 0.22 parts/1 minute. Toner particles (R1) have a volume average particle diameter of 5.8 μm. Toner (R1) and Developer (R1) are prepared by using Toner particles (R1) in the same manner as in Example 1.

Example 7

Toner particles (R2) are obtained in the same manner as in preparing of Toner particles (1) in Example 1 except that the liquid transport speed of the tube pump A is set to 0.75 parts/1 minute, the liquid transport speed of the tube pump B is set to 0.14 parts/1 minute and the tube pumps A and B are driven from a point of time when the temperature of the inside of the flask reaches 35° C., and at the time when the temperature of the inside of the flask reaches 39° C., the liquid transport speed of the tube pump B is changed to 0.08 parts/1 minute. Toner particles (R2) have a volume average particle diameter of 5.6 μm. Toner (R2) and Developer (R2) are prepared by using Toner particles (R2) in the same manner as in Example 1.

Various Measurements

Regarding the toner of the developer obtained in each of the examples, the maximum frequent value, the skewness, and the kurtosis in the distribution of the eccentricity B of the release agent domain are measured by using the above-described method. A shape factor of the toner particles is also measured by using the above-described method. The results are shown in Table 1.

Evaluation

A developing device of an evaluation device "DOCUCENTREIV C3370 (product manufactured by Fuji Xerox Co., Ltd.) is filled with each of the developers obtained in the examples. A fixing device of an electromagnetic induction heating system is mounted in this evaluation device. In the evaluation device, the width of a fixation belt in the fixing device is set to 460 mm, and the width of a pressure roller (length in an axial direction of the pressure roller) is set to 480 mm. The evaluation device is modified such that the electromagnetic induction heating fixing device is shifted to the direction intersecting with the transport direction of a recording sheet (direction along the axial direction of the pressure roller), and the passing position of a recording sheet at a nip portion is changeable. Modification is performed such that this fixing device is driven by an external driving motor and a temperature may be controlled. The following evaluations are performed by using this evaluation device. The results are shown in Table 1.

Evaluation of Uneven Gloss of Image

Uneven gloss of an image is evaluated as follows. In the evaluation device, a solid unfixed image is printed on an A3 recording sheet (paper of "OK TOP COAT+", product manufactured by Oji Paper Co., Ltd.). Then, after the fixing device is driven and the temperature is adjusted to be 190 degrees, the unfixed image is fixed. 60 degrees gloss is measured for 24 points from an end portion of the fixed image at a predetermined interval by using a gloss meter (BYK MICRO-TRI gross meter)(20+60+85°, product manufactured by Gardner Inc.). The uneven gloss is evaluated based on a difference (maximum value−minimum value) in gloss level at the 24 points. The evaluation standards are as follows.

A: a difference in the gloss level is less than 5%, and standard deviation at 24 points at which gloss level is measured is equal to or less than 2.5

B: a difference in the gloss level is less than 5%

C: a difference in the gloss level is 5% or greater and less than 10%

D: a difference in the gloss level is equal to or greater than 10%

Offset Evaluation When Single-Sided Printing Is Performed

Offset when single-sided printing is performed is evaluated as follows. An unfixed image which has image density of 100%, and a size of 10 cm×10 cm is printed at a position 1 cm away from the upper end of PREMIER 80 A4 WHITE PAPEER (product manufactured by Xerox Corporation, basis weight of 80 g/m$^2$). Then, in fixing of the unfixed image, the fixation temperature is increased from 170 degrees up to 220 degrees in increments of 5° C. When an offset occurs during this period of time, the temperature before the offset occurs is recorded. The evaluation standards are as follows.

A: no occurrence of offset

B: from 205° C. to 220° C.

C: 185° C. or greater and less than 205° C.

D: less than 185° C.

Offset Evaluation when Double-Sided Printing is Performed

Offset when double-sided printing is performed is evaluated as follows. Unfixed images which have image density of 100%, and a size of 10 cm×10 cm are formed on both sides at a position 1 cm away from the upper end of PREMIER 80 A4 WHITE PAPEER (product manufactured by Xerox Corporation, basis weight of 80 g/m$^2$). A sample is prepared which is in a state where the unfixed image on the surface side is fixed and the unfixed image on the back surface side remain as it is. Then, in fixing of the unfixed image on the back surface side, the fixation temperature is increased from 170 degrees to 220 degrees in increments of 5° C. When an offset occurs during this period of time, the temperature before the offset occurs is recorded. The evaluation standards are as follows.

A: no occurrence of offset

B: from 205° C. to 220° C.

C: 185° C. or greater and less than 205° C.

D: less than 185° C.

TABLE 1

| | Distribution of eccentricity B of release agent domain | | | Evaluation | | |
|---|---|---|---|---|---|---|
| | Maximum frequent value | Skewness | Kurtosis | Uneven gloss of image | Offset in single-sided printing | Offset in double-sided printing |
| Example 1 | 0.88 | −0.8 | 0.6 | A | A | A |
| Example 2 | 0.77 | −1.08 | 0.5 | A | A | A |
| Example 3 | 0.76 | −0.52 | 0.62 | A | A | A |
| Comparative Example 1 | 1 | −1.07 | 0.62 | D | D | D |
| Comparative Example 2 | 0.98 | −0.51 | 0.65 | D | C | D |
| Comparative Example 3 | 0.74 | −1.08 | 0.53 | D | D | C |
| Comparative Example 4 | 0.74 | −0.52 | 0.63 | C | D | D |
| Comparative Example 5 | 0.76 | −1.12 | 0.52 | D | C | D |
| Comparative Example 6 | 0.76 | −0.48 | 0.6 | D | D | C |
| Comparative Example 7 | 0.99 | −1.13 | 0.48 | C | C | D |
| Comparative Example 8 | 0.99 | −0.47 | 0.59 | D | C | D |
| Example 4 | 0.85 | −0.81 | 1.48 | A | A | A |
| Example 5 | 0.82 | −0.7 | −0.19 | A | A | A |
| Example 6 | 0.84 | −0.79 | 1.6 | B | A | B |
| Example 7 | 0.84 | −0.65 | −0.24 | A | B | A |

It is confirmed based on the above results that occurrence of offset is prevented both when single-sided printing is performed and when double-sided printing is performed, compared to the comparative examples, in these examples. It is confirmed that gloss level of an image is good in these examples.

Particularly, it is confirmed that occurrence of offset is prevented both when single-sided printing is performed and when double-sided printing is performed in Examples 4 and 5 in which the kurtosis in the distribution of the eccentricity B of the release agent domain is in the range of from −0.20 to +1.50, in comparison to in Examples 6 and 7.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charging unit that charges a surface of the image holding member;

an electrostatic latent image forming unit that forms an electrostatic latent image on a charged surface of the image holding member;

a developing unit that stores a developer containing a toner and develops the electrostatic latent image formed on the surface of the image holding member by using the developer so as to form a toner image;

a transfer unit that transfers the toner image onto a surface of a recording medium;

a fixing unit that includes a first member and a second member contacting with the first member, and fixes the toner image transferred on the surface of the recording medium while transporting the recording medium with a contact portion of the first member and the second member; and a moving unit that moves at least one of the first member and the second member toward a direction intersecting with a transporting direction of the recording medium, wherein the toner contains a binder resin, a colorant, and a release agent and has a sea portion containing the binder resin and an island portion containing the release agent, a maximum frequent value in distribution of the following eccentricity B of the island portion containing the release agent is in a range of from 0.75 to 0.95, and a skewness in the distribution of the following eccentricity B is in a range of from −1.10 to −0.50, the eccentricity B being represented by the following expression (1):

$$\text{Eccentricity } B=2d/D \quad (1)$$

wherein D indicates an equivalent circle diameter (μm) of the toner in an observation of a cross-section of the toner, and d indicates a distance (μm) from the centroid of the toner to the centroid of the island portion containing the release agent in the observation of a cross-section of the toner.

2. The image forming apparatus according to claim 1, wherein a fixation temperature by the fixing unit is equal to or higher than 100° C. and lower than 190° C.

3. The image forming apparatus according to claim 1, wherein a kurtosis of the distribution of the eccentricity B in the toner is in a range of from −0.20 to +1.50.

4. The image forming apparatus according to claim 1, wherein the maximum frequent value in distribution of the eccentricity B in the toner is in a range of from 0.80 to 0.90.

5. The image forming apparatus according to claim 1, wherein a kurtosis of the distribution of the eccentricity B in the toner is in a range of from −0.10 to +1.40.

6. The image forming apparatus according to claim 1, wherein the moving unit includes a driving source.

7. An image forming method comprising:

charging a surface of an image holding member;

forming an electrostatic latent image on a charged surface of the image holding member;

developing the electrostatic latent image formed on the surface of the image holding member by using a developer containing a toner so as to form a toner image;

transferring the toner image onto a surface of a recording medium;

fixing the toner image transferred on the surface of the recording medium while transporting the recording medium with a contact portion of a first member and a second member contacting with the first member; and moving at least one of the first member and the second member toward a direction intersecting with a transport direction of the recording medium, wherein the toner contains a binder resin, a colorant, and a release agent and has a sea portion containing the binder resin and an island portion containing the release agent, a maximum frequent value in distribution of the following eccentricity B of the island portion containing the release agent is in a range of from 0.75 to 0.95, and a skewness in the distribution of the following eccentricity B is in a range of from −1.10 to −0.50, the eccentricity B being represented by the following expression (1):

$$\text{Eccentricity } B=2d/D \quad (1)$$

wherein D indicates an equivalent circle diameter (μm) of the toner in an observation of a cross-section of the toner, and d indicates a distance (μm) from the centroid of the toner to the centroid of the island portion containing the release agent in the observation of a cross-section of the toner.

8. The image forming method according to claim 7, wherein a fixation temperature in the fixing is equal to or higher than 100° C. and lower than 190° C.

9. The image forming method according to claim 7, wherein a kurtosis of the distribution of the eccentricity B in the toner is in a range of from −0.20 to +1.50.

10. The image forming method according to claim 7, wherein the maximum frequent value in distribution of the eccentricity B in the toner is in a range of from 0.80 to 0.90.

11. The image forming method according to claim 7, wherein a kurtosis of the distribution of the eccentricity B in the toner is in a range of from −0.10 to +1.40.

* * * * *